US006406332B1

(12) United States Patent
Buican et al.

(10) Patent No.: US 6,406,332 B1
(45) Date of Patent: Jun. 18, 2002

(54) TRANSLATING LOCKABLE CARD EDGE TO CARD EDGE CONNECTOR

(75) Inventors: Eugene Buican; Jason Q. Paulsel, both of Austin, TX (US)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 09/690,963

(22) Filed: Oct. 17, 2000

(51) Int. Cl.[7] ..... H01R 24/00
(52) U.S. Cl. ..... 439/631
(58) Field of Search ..... 439/76.1, 637, 439/60, 152, 326, 327, 59, 629, 633; 361/785

(56) References Cited

U.S. PATENT DOCUMENTS

| | | | | | |
|---|---|---|---|---|---|
| 3,795,888 | A | | 3/1974 | Nardo et al. | 339/176 |
| 4,193,108 | A | | 3/1980 | Romano | 361/399 |
| 4,400,049 | A | * | 8/1983 | Schuck | 439/67 |
| 4,780,095 | A | | 10/1988 | Classon et al. | 439/637 |
| 5,403,208 | A | * | 4/1995 | Felcman et al. | 439/633 |
| 5,421,738 | A | | 6/1995 | Roberts | 439/260 |
| 5,486,657 | A | | 1/1996 | Bell et al. | 174/261 |
| 5,492,478 | A | * | 2/1996 | White | 439/76.1 |
| 5,567,295 | A | | 10/1996 | Swamy et al. | 205/125 |
| 5,593,322 | A | | 1/1997 | Swamy et al. | 439/660 |
| 5,655,922 | A | | 8/1997 | Dux et al. | 439/213 |
| 5,781,414 | A | | 7/1998 | Mills et al. | 361/786 |
| 5,842,880 | A | | 12/1998 | Pei | 439/327 |
| 5,865,649 | A | | 2/1999 | Yu et al. | 439/637 |
| 5,961,352 | A | * | 10/1999 | Denny et al. | 439/637 |
| 6,000,955 | A | | 12/1999 | Zaderej | 439/79 |
| 6,007,357 | A | * | 12/1999 | Perino et al. | 439/327 |
| 6,010,368 | A | | 1/2000 | Tai | 439/637 |
| 6,015,299 | A | | 1/2000 | Walse et al. | 439/60 |
| 6,017,248 | A | | 1/2000 | Pan et al. | 439/681 |
| 6,055,725 | A | | 5/2000 | Berto et al. | 29/879 |

FOREIGN PATENT DOCUMENTS

| | | | | |
|---|---|---|---|---|
| DE | 4438801 | * | 1/1996 | 439/67 |

* cited by examiner

*Primary Examiner*—Neil Abrams
*Assistant Examiner*—J. F. Duverne
(74) *Attorney, Agent, or Firm*—Skjerven Morrill LLP; D'Ann N. Rifai

(57) ABSTRACT

A card edge connector with a plurality of card-receiving areas for receiving circuit board edges and an electrical contact designed to electrically connect circuit boards with edges inserted into the card-receiving areas. The card edge connector is designed to be used with at least two circuit boards installed within an apparatus, such as a computer chassis, in a fixed position. The card edge connector is designed to be removably installed on one of the circuit boards. The card edge connector is adapted to slide, or translate, over the circuit board on which it is installed and onto the contacts of another fixed circuit board. An electrical connection is established between the fixed circuit boards, which remain stationary while the card edge connector slides to form the electrical connection between them.

19 Claims, 6 Drawing Sheets

TRANSLATING LOCKABLE CARD EDGE TO CARD EDGE CONNECTOR

BACKGROUND OF THE INVENTION

1. Field of the Invention

This invention relates to electro-mechanical connectors for circuit boards, and more particularly to edge connectors that mechanically secure and electrically connect the edge portions of circuit boards.

2. Description of the Related Art

A typical computer is highly modular. During a computer's useful life, usually one or more components are replaced, either due to system maintenance or upgrades. Most computer components are designed to be replaceable and are supported on a "pluggable" printed circuit board. With technological progress, computers are continually operating at higher frequencies and increasing circuit density. The number of components normally installed as part of a computer system has therefore increased, yet consumers expect computers to increasingly become smaller and lighter. With limited space in a computer chassis to contain these components, circuit boards have become more closely packed.

Electrical connectors are designed to provide conductive paths between adjacent circuit boards. With increasing circuit density, the electrical connectors and the electrical terminals they include are smaller and there are more of them.

Connectors between adjacent circuit boards are often installed on a primary, or "mother" board, and are adapted to receive the edges of secondary, or "daughter" boards. These connectors connect the edge of the daughter board to a socket on the mother board. Often daughter boards are installed such that the daughter board is perpendicular to the motherboard. These connectors are called edge connectors and are used in modem electrical equipment that contains a number of parallel daughter boards that are closely packed together.

Edge connectors often comprise a number of conductive contacts that are spaced apart and arranged linearly in a housing. Each contact is metallic, and is positioned to abut a conductive contact on the edge of the daughter board. Often the contacts are arranged in two parallel rows so the daughter board can be inserted between the rows. When a daughter board is positioned between the rows, the contacts exert a gripping force on the daughter board so as to secure it in the housing.

One disadvantage to using edge connectors in this way is that the increasingly smaller sizes of motherboards limit the number of sockets and therefore the number of components that can be installed. Furthermore, with increased density of components and connections within the computer chassis, assembling a computer or replacing a component is an intricate process. Moving a circuit board during assembly complicates the process and compromises electromagnetic shielding. Minimizing the number of components to be moved and designing the system to move less complex components simplifies assembly and replacement of components. A simplified mechanical design also minimizes the amount of electromagnetic interference between these closely packed components. Finally, optimizing the layout of components in the limited space within the chassis is necessary to meet consumer demands for smaller and lighter computers.

What is needed is an inexpensive device, which allows for dense placement of circuit boards within a computer chassis, while minimizing the number of complex components to be moved, limiting electromagnetic interference, and optimizing the layout of components within the chassis.

SUMMARY OF THE INVENTION

In one embodiment of the invention, a card edge connector has at least two card-receiving areas for receiving at least two circuit board edges. The card edge connector includes an electrical contact for electrically connecting with an electrical contact on the edges of each of the circuit boards.

In another embodiment of the invention, each card edge connector electrical contact is formed from a continuous piece of metal. Each connector electrical contact thereby can contact electrical contacts on more than one circuit board simultaneously, thereby forming an electrical connection between multiple circuit boards.

In another embodiment of the invention, an apparatus includes at least two circuit boards and a card edge connector with card-receiving areas for receiving the edges of the circuit boards and forming an electrical connection between the circuit boards. The card edge connector is designed to be removably installed on one circuit board and to connect with an electrical contact on the edge of another circuit board.

The connector electrical contacts touch the electrical contacts of the edge of the circuit board when the edge is inserted into the respective card-receiving area of the connector. When the connector is placed between the circuit boards and the respective card edges are inserted into the respective card-receiving areas, the connector establishes an electrical connection between the circuit boards.

In another embodiment, each circuit board is installed within the apparatus in a fixed position. The card edge connector is adapted to slide, or translate, over the circuit board edge on which it is installed and onto the electrical contacts of the edge of at least one of other circuit boards. The electrical connection is established between the fixed circuit boards, which remain stationary while the card edge connector slides to form an electrical connection between them.

In another embodiment of the invention, a computer system includes a processor, a motherboard for the processor, a memory, and the card edge connector described above.

A further embodiment is a computer system as described above, where the motherboard is split into two circuit boards, a motherboard proper and a smaller detachable expansion board. The edge connector is installed on either the expansion board or the motherboard proper and slides to connect with electrical contacts on the other. This embodiment allows the expansion board to be placed within the computer system to maximize space for adding components, and yet provides the necessary connection of the components to the motherboard proper. The motherboard proper and the expansion board are stationary while the electrical connection is made between them.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

Figure 1:
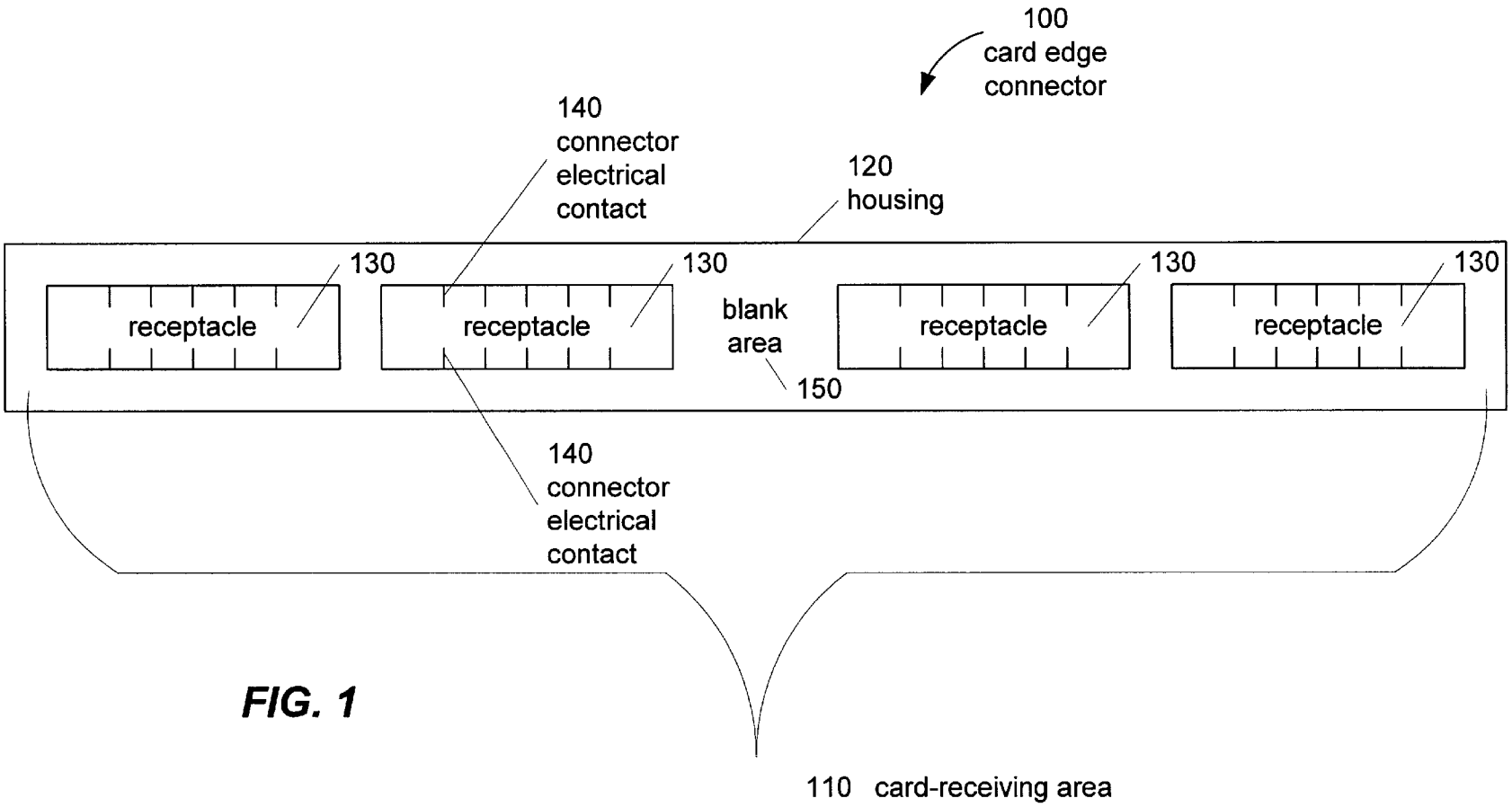
FIG. 1 is a side view of a card edge connector.

FIG. 1 is a side view of card edge connector 100. In the embodiment shown in FIG. 1, two opposing sides of card edge connector 100 are configured identically, so that FIG. 1 represents a view of either side of card edge connector 100. Card edge connector 100 has a housing 120 and at least two card-receiving areas, each being a card-receiving area 110, where each card-receiving area 110 receives the edge of a circuit board (not shown). Other embodiments may include more than two card-receiving areas for receiving the edges of more than two circuit boards.

Inside each card-receiving area 110, card edge connector 100 includes at least one connector electrical contact 140 for electrically connecting the circuit boards. In the embodiment shown in FIG. 1, each card-receiving area 110 includes a number of receptacles 130. Each receptacle is designed to receive a portion of the edge of the circuit board. Each receptacle 130 includes a connector electrical contact 140.

When card edge connector 100 is placed between the circuit boards and the respective circuit board edges (not shown) are each inserted into a respective card-receiving area 110, card edge connector 100 establishes an electrical connection between the circuit boards. A blank area 150 of the housing between receptacles 130 allows for a sliding mechanism to be added to the housing 120 of card edge connector 100.

Figure 2:
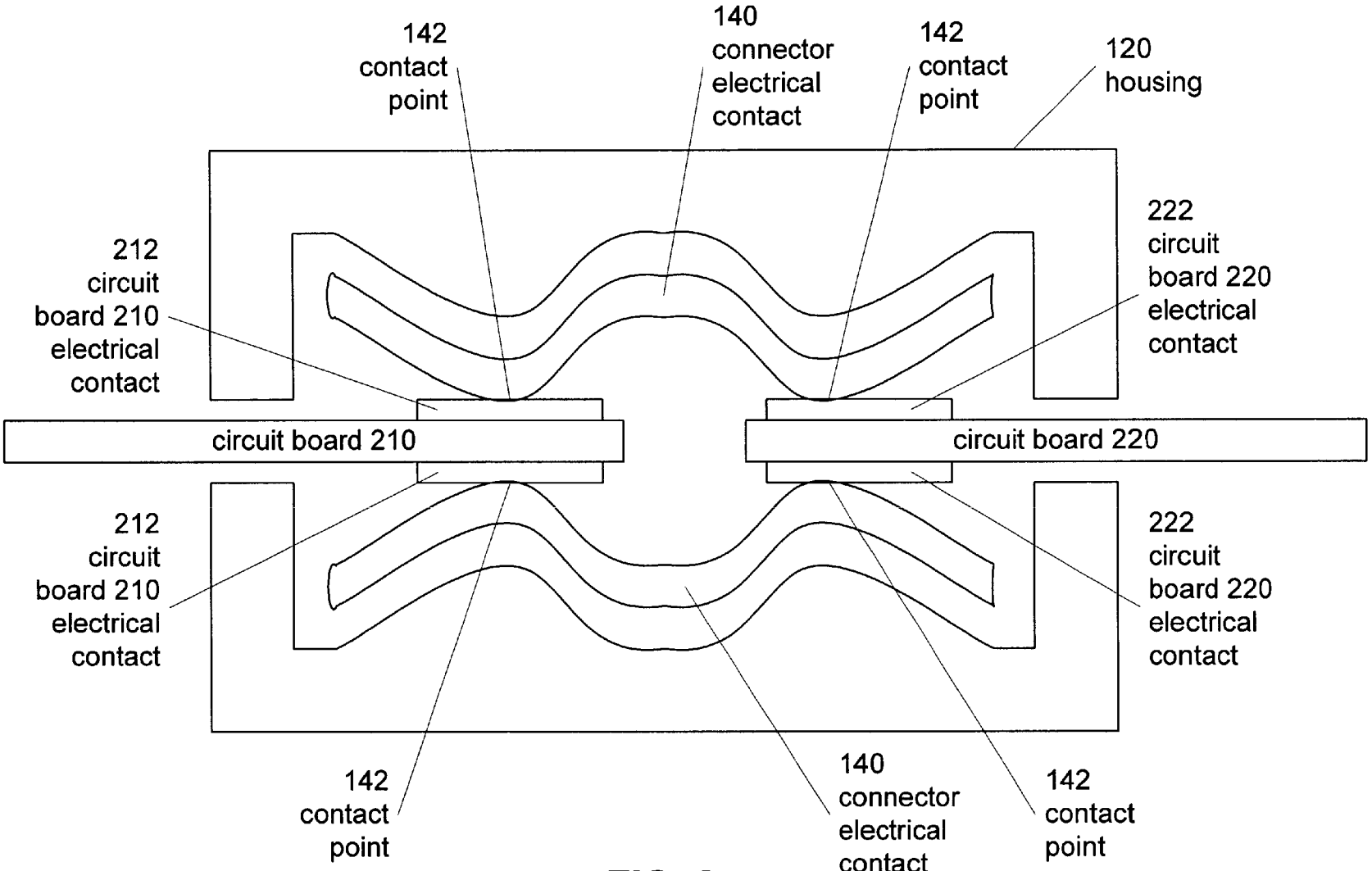
FIG. 2 is a cross-sectional view of the card edge connector of FIG. 1.

FIG. 2 is a cross-sectional view of card edge connector 100. In the embodiment of the invention shown in FIG. 2, each connector electrical contact 140 is formed from a continuous piece of metal and has more than one contact point 142. Each connector electrical contact 140 thereby contacts circuit board 210 electrical contact 212 and circuit board 220 electrical contact 222 simultaneously at corresponding contact points. Connector electrical contact 140, circuit board 210 electrical contact 212 and circuit board 220 electrical contact 222 together form an electrical connection between circuit boards 210 and 220.

Figure 3:
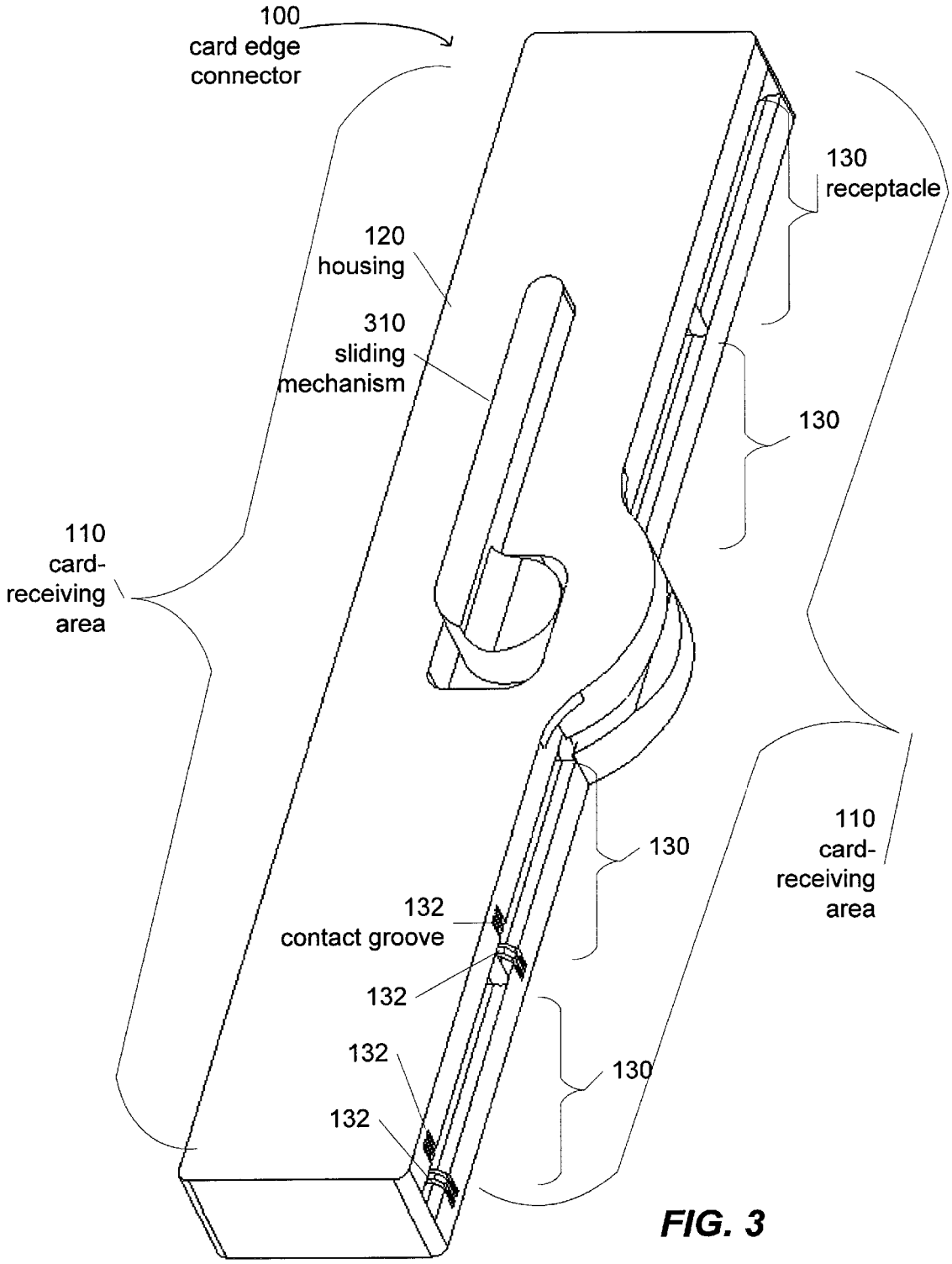
FIG. 3 is a perspective view of the card edge connector of FIGS. 1 and 2 with a sliding mechanism.

FIG. 3 is a perspective view of a card edge connector 100 with a sliding mechanism 310 added to housing 120. Sliding mechanism 310 is placed on card edge connector 100 at blank area 150 shown in FIG. 1 to allow the sliding mechanism to lock the connected circuit boards into place. In the embodiment shown in FIG. 3, card edge connector 100 has two card-receiving areas, each being a card-receiving area 110, to connect a pair of circuit board edges (not shown).

FIG. 3 also shows examples of contact grooves in housing 120, each contact groove 132 being designed to hold a connector electrical contact 140. Only four example contact grooves are shown in the figure, although card edge connector 100 may contain multiple contact grooves to hold multiple connector electrical contacts.

One embodiment of card edge connector 100 is designed to be removably installed on one of the circuit boards to be connected. The circuit boards are installed as part of an apparatus in fixed positions, such as within a computer system chassis. Each circuit board is installed with an edge adjacent to an edge of another circuit board. Card edge connector 100 is adapted to slide via sliding mechanism 310 over the circuit board on which it is installed and onto the contact of the edge of another circuit board. The electrical connection is established between the fixed circuit boards, each of which remains stationary while the card edge connector 100 slides to form the electrical connection. The system design so that the connector and not the circuit boards is moved during assembly simplifies assembly and limits electromagnetic interference between components.

Figure 4:
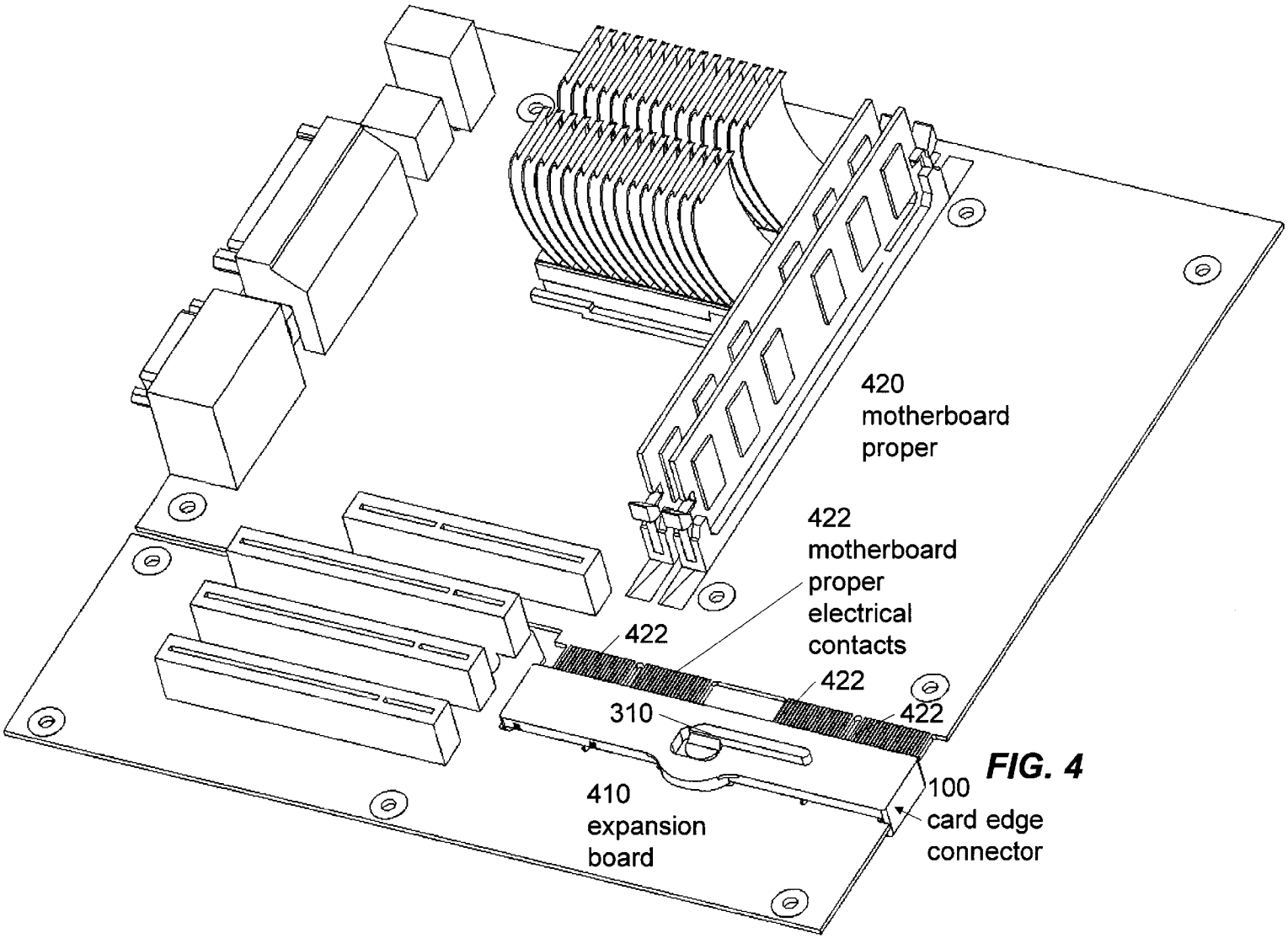
FIG. 4 is a view of two circuit boards ready to be connected by the card edge connector with the sliding mechanism of FIG. 3.

FIG. 4 is a view of an apparatus including two circuit boards and card edge connector 100 with sliding mechanism 310 of FIG. 3. The two circuit boards are positioned to be connected by card edge connector 100. In the embodiment shown in FIG. 4, a motherboard is split into two circuit boards, a motherboard proper 420 and a smaller detachable expansion board 410. Card edge connector 100 is installed on the expansion board 410 and slides to connect with motherboard proper electrical contacts 422 while maintaining contact with electrical contacts on the expansion board (not shown). Each contact of motherboard proper electrical contacts 422 is an electrical contact such as circuit board 210 electrical contact 212 or circuit board 220 electrical contact 222 of FIG. 2.

This embodiment allows the expansion board 410 to be positioned within the apparatus to maximize space for adding components, and yet provides the necessary connection of the components to the motherboard proper 420. The motherboard proper 420 and the expansion board 410 are stationary while card edge connector 100 slides to make an electrical connection between them. Sliding mechanism 310 is shown in FIG. 4 in the position it would be prior to sliding to connect with the motherboard proper 420. Dividing the motherboard into two components allows more flexibility in designing the layout of components within the computer.

Figure 5:
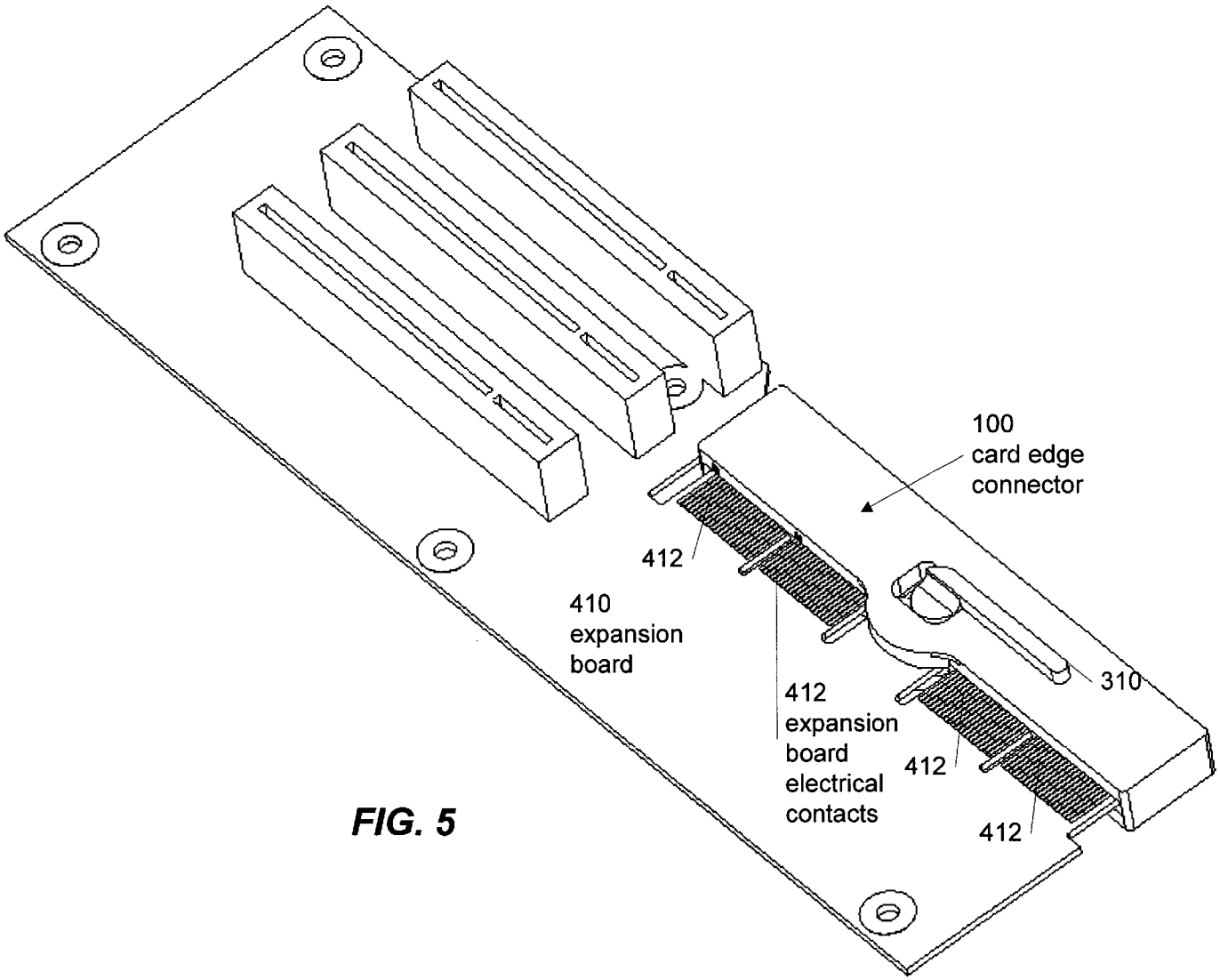
FIG. 5 is a view of one of the circuit boards of FIG. 4 and the card edge connector of FIG. 3.

FIG. 5 is a view of card edge connector 100 with sliding mechanism 310 of FIG. 3 installed on expansion board 410. Connector electrical contacts 140 of card edge connector 100 are arranged to connect with expansion board electrical contacts 412. When card edge connector 100 is moved over motherboard proper 420 (not shown), connector electrical contacts 140 simultaneously contact motherboard proper electrical contacts 422 and expansion board electrical contacts 412. Card edge connector 100 is shown in FIG. 5 in the position it would be after sliding to connect with motherboard proper 420 (not shown).

Figure 6:
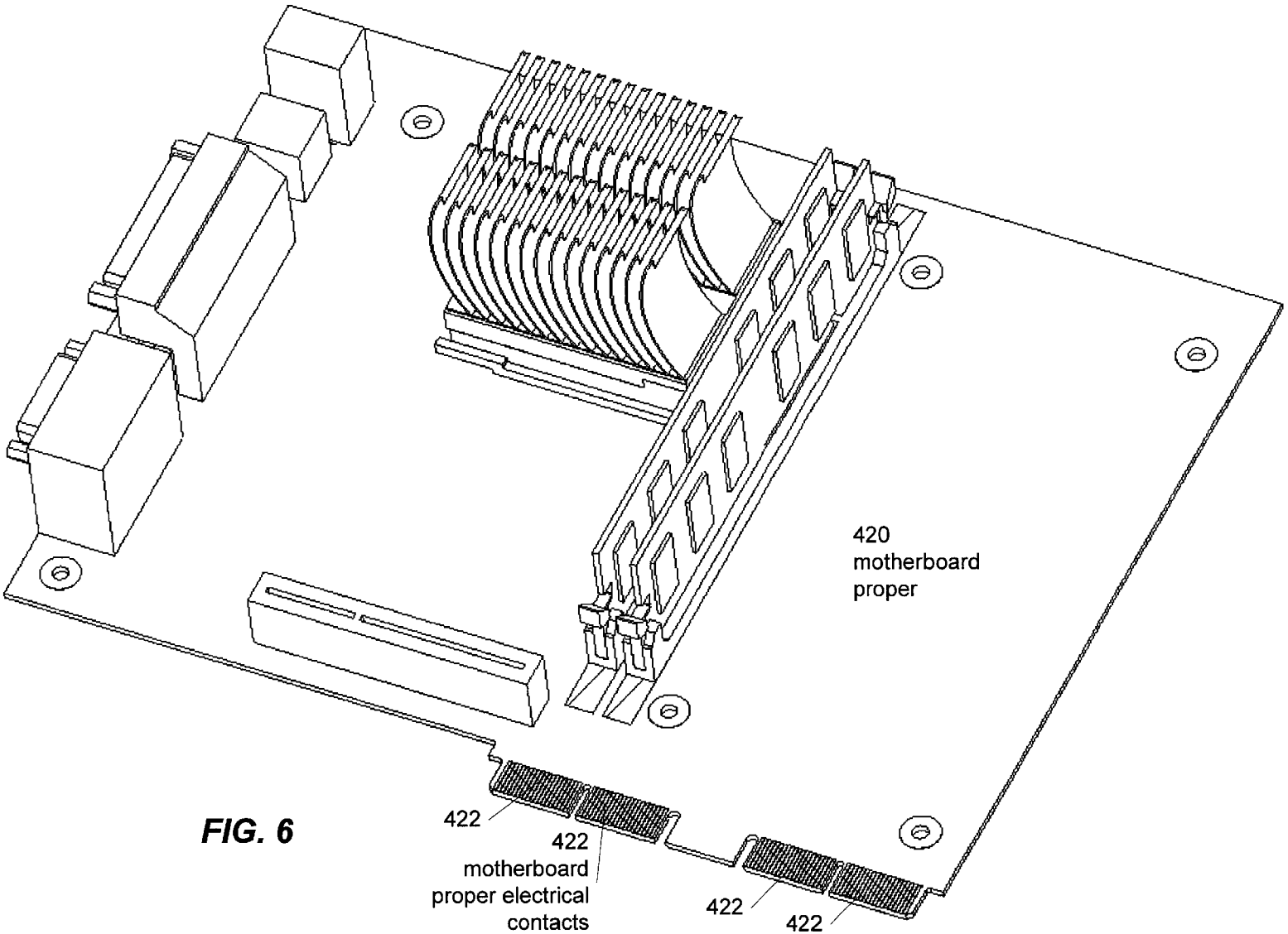
FIG. 6 is a view of the other circuit board of FIG. 4.

FIG. 6 is a view of motherboard proper 420. Card edge connector 100 contacts 140 are arranged to connect with motherboard proper electrical contacts 422 and expansion board electrical contacts 412 (not shown) simultaneously.

What is claimed is:

1. A card edge connector comprising:

a plurality of card-receiving areas, each card-receiving area of the plurality of card-receiving areas for receiving an edge of a circuit board of a plurality of circuit boards;

a connector electrical contact to electrically connect with a circuit board electrical contact of the edge of each circuit board of the plurality of circuit boards simultaneously, thereby electrically connecting the plurality of circuit boards; and a sliding mechanism for sliding the card edge connector between a first circuit board of the circuit boards and a second circuit board of the circuit boards such that:

the connector electrical contact simultaneously contacts a first circuit board electrical contact of the first circuit board and a second circuit board electrical contact of the second circuit board after the card edge connector slides; and the first circuit board remains stationary and the second circuit board remains stationary when the sliding mechanism slides the card edge connector.

2. The card edge connector of claim 1 wherein the connector electrical contact is formed from a continuous piece of metal, the connector electrical contact having a plurality of contact points, each contact point to contact the circuit board electrical contact of the edge of one circuit board of the plurality of circuit boards.

3. The card edge connector of claim 1 wherein the card edge connector includes a plurality of connector electrical contacts.

4. The card edge connector of claim 3, wherein each card-receiving area comprises a plurality of receptacles, each receptacle of the plurality of receptacles for receiving a portion of an edge of one circuit board of the plurality of circuit boards; and each receptacle includes a connector electrical contact of the plurality of connector electrical contacts.

5. The card edge connector of claim 1 wherein the card edge connector is adapted to be removably installed on a circuit board of the plurality of circuit boards.

6. The card edge connector of claim 1 wherein the card edge connector includes a housing with the sliding mechanism.

7. An apparatus comprising:

a plurality of circuit boards, each circuit board of the circuit boards having an edge, the edge of said each circuit board having a circuit board electrical contact; and a card edge connector comprising:

a plurality of card-receiving areas, each card-receiving area for receiving the edge of a circuit board of the plurality of circuit boards; and a connector electrical contact to electrically connect with the circuit board electrical contact of the edge of each circuit board of the plurality of circuit boards simultaneously, thereby electrically connecting the plurality of circuit boards;

wherein a first circuit board of the circuit boards is installed in a first fixed position within the apparatus; and a second circuit board of the circuit boards is installed in a second fixed position within the apparatus.

8. The apparatus of claim 7 wherein the plurality of circuit boards is arranged such that a first circuit board edge of the first circuit board is adjacent to a second circuit board edge of the second circuit board.

9. The apparatus of claim 7 wherein each connector electrical contact is formed from a continuous piece of metal, the connector electrical contact having a plurality of contact points, each contact point to contact the circuit board electrical contact of the edge of one circuit board of the plurality of circuit boards.

10. The apparatus of claim 7 wherein the card edge connector is removably installed on the first circuit board.

11. The apparatus of claim 7 wherein the card edge connector is installed on the first circuit board; and the card edge connector further comprises a sliding mechanism to cause the card edge connector to slide over the first circuit board and onto the second circuit board such that a connector electrical contact simultaneously contacts a first circuit board electrical contact of the first circuit board and a second circuit board electrical contact of the second circuit board.

12. The apparatus of claim 11 wherein the first circuit board remains in the first fixed position and the second circuit board remains in the second fixed position when the card edge connector slides.

13. A computer system comprising:

a processor;

a memory;

a plurality of circuit boards; and a card edge connector comprising:

a plurality of card-receiving areas, each card-receiving area of the plurality of card-receiving areas for receiving an edge of a circuit board of the plurality of circuit boards; and a connector electrical contact to electrically connect with a circuit board electrical contact of the edge of each circuit board of the plurality of circuit boards simultaneously, thereby electrically connecting the plurality of circuit boards;

wherein a first circuit board of the circuit boards is installed in a first fixed position within the computer system; and a second circuit board of the circuit boards is installed in a second fixed position within the computer system.

14. A computer system comprising:

a processor;

a memory;

a motherboard for the processor, the motherboard including a motherboard proper and an expansion board, wherein the expansion board is detachable from the motherboard proper, the motherboard proper having an edge with a motherboard proper electrical contact, and the expansion board having an edge with an expansion board electrical contact; and a card edge connector comprising:

a plurality of card-receiving areas, each card-receiving area for receiving an edge of one of the motherboard proper and the expansion board; and a connector electrical contact to electrically connect with the motherboard proper electrical contact and the expansion board electrical contact simultaneously, thereby electrically connecting the motherboard proper and the expansion board;

wherein the motherboard proper is installed in a first fixed position within the computer system; and the expansion board is installed in a second fixed position within the computer system.

15. The computer system of claim 14, wherein the card edge connector is installed on one of the expansion board and the motherboard proper; and the card edge connector comprises a sliding mechanism to cause the card edge connector to slide to simultaneously contact the expansion board electrical contact and the motherboard proper electrical contact.

16. The computer system of claim 14 wherein the motherboard proper remains in the first fixed position and the expansion board remains in the second fixed position while the card edge connector slides to form an electrical connection between the motherboard proper and the expansion board.

17. The apparatus of claim 7 wherein the card edge connector further comprises a sliding mechanism that causes the card edge connector to slide between the first circuit board and the second circuit board.

18. An apparatus comprising:

a plurality of circuit boards, each circuit board of the circuit boards having an edge, the edge of said each circuit board having a respective circuit board electrical contact; and a card edge connector comprising:

a plurality of card-receiving areas, each card-receiving area for receiving the edge of a circuit board of the plurality of circuit boards; and a connector electrical contact to electrically connect with the circuit board electrical contact of the edge of each circuit board of the plurality of circuit boards simultaneously, thereby electrically connecting the plurality of circuit boards;

wherein the card edge connector is installed on a first circuit board of the circuit boards;

the card edge connector is adapted to slide over the first circuit board and onto a second circuit board of the circuit boards such that a connector electrical contact simultaneously contacts a first circuit board electrical contact of the first circuit board and a second circuit board electrical contact of the second circuit board; and the first circuit board and the second circuit board remain stationary when the card edge connector slides.

19. The apparatus of claim 18, wherein:

the card edge connector further comprises a sliding mechanism that causes the card edge connector to slide.

* * * * *